US006497555B2

(12) United States Patent
Kraner

(10) Patent No.: US 6,497,555 B2
(45) Date of Patent: Dec. 24, 2002

(54) LIQUID RING PUMP

(75) Inventor: Edmund Kraner, Erlangen (DE)

(73) Assignee: Siemens Aktiengesellschaft, München (DE)

( * ) Notice: Subject to any disclaimer, the term of this patent is extended or adjusted under 35 U.S.C. 154(b) by 0 days.

(21) Appl. No.: 09/828,309

(22) Filed: Apr. 6, 2001

(65) Prior Publication Data

US 2001/0026759 A1 Oct. 4, 2001

Related U.S. Application Data

(63) Continuation of application No. PCT/DE99/03279, filed on Oct. 12, 1999.

(30) Foreign Application Priority Data

Oct. 15, 1998 (DE) ..... 198 47 681

(51) Int. Cl.[7] ..... F04C 19/00

(52) U.S. Cl. ..... 417/68; 417/70; 417/423.6

(58) Field of Search ..... 417/68, 410.3, 417/423.6, 65, 70

(56) References Cited

U.S. PATENT DOCUMENTS

| | | | | | |
|---|---|---|---|---|---|
| 3,712,764 | A | * | 1/1973 | Shearwood | 418/68 |
| 4,050,851 | A | * | 9/1977 | Haavik | 417/68 |
| 4,132,504 | A | * | 1/1979 | Fitch | 417/68 |
| 4,218,176 | A | * | 8/1980 | Gawne | 415/90 |
| 4,498,844 | A | * | 2/1985 | Bissell et al. | 417/68 |
| 4,679,987 | A | * | 7/1987 | Olsen | 417/54 |
| 4,850,808 | A | * | 7/1989 | Schultze et al. | 417/68 |
| 5,078,573 | A | * | 1/1992 | Peroaho et al. | 415/169.1 |

FOREIGN PATENT DOCUMENTS

| | | |
|---|---|---|
| DE | 26 45 305 | 5/1977 |
| DE | 27 31 451 B | 4/1978 |
| DE | 29 12 938 A | 10/1980 |
| DE | 37 11 121 A | 12/1988 |
| JP | 59 015690 A | 1/1984 |

* cited by examiner

*Primary Examiner*—Charles G. Freay
*Assistant Examiner*—Han L Liu
(74) *Attorney, Agent, or Firm*—Henry M. Feiereisen

(57) ABSTRACT

A liquid ring pump, includes a stationary housing having an interior space for accommodating at least one rotor mounted on a rotor shaft for rotation in the housing. The rotor shaft is supported by a bearing in the interior space, and the rotor is operated by a drive which acts on the outer perimeter of the rotor.

16 Claims, 6 Drawing Sheets

LIQUID RING PUMP

CROSS-REFERENCES TO RELATED APPLICATIONS

This application is a continuation of prior filed copending PCT International application no. PCT/DE99/03279, filed Oct. 12, 1999.

This application claims the priority of German Patent Application Serial No. 198 47 681.7, filed Oct. 15, 1998, the subject matter of which is incorporated herein by reference.

BACKGROUND OF THE INVENTION

The present invention relates especially but not exclusively to a liquid ring pump.

German Pat. No. DE 27 31 451 describes a liquid ring pump or compressor having a rotor floatingly mounted to the extended shaft end of the drive motor. The motor casing is so configured that operating liquid of the compressor or pump is able to circulate therein and cool the motor housing. Apart from the fact that the motor casing must be designed in a particular way, it is also necessary to provide reinforced motor shafts and shaft bearings as well as complex seals between the pump or compressor, on the one hand, and the drive motor, on the other hand, whereby the space for the seals is relatively small and inaccessible during operation.

German Pat. No. DE 26 45 305 describes a liquid ring pump and compressor having a rotor accommodated in a hermetically sealed casing, with the seals configured in the form of glands or mechanical seals. Disposed about the housing are coils to form a stator winding. As the coils are excited, a field is induced in the ferromagnetic liquid contained within the housing, thereby forming a peripheral liquid ring adhering to the interior surface of the casing. Interaction between the ring and the rotor vanes causes the rotor to turn to implement a pumping action. The drive of the rotor is thus based on a magnetic engagement of the rotor with the field. As a consequence, the use of nonmagnetic materials such as stainless steels, high alloy nickel or plastics for the rotor is precluded. However, these types of materials are in particular suitable for rotors in liquid ring pumps handling toxic and/or aggressive transport fluids. In addition, the transmission of driving forces through induction of a field has a relatively poor efficiency.

To solve these problems, German Pat. No. DE 29 12 938 discloses a liquid ring pump having a cylindrical pump housing with a rotor mounted eccentrically in the housing. An electric motor drives the pump via a canned magnetic coupling which is hermetically sealed from the pump portion by an enclosure, thereby attempting to combine better driving conditions with a hermetic seal of the pump housing. Apart from the fact that canned magnetic couplings are only suitable for pump outputs of up to about 50 KW, this conventional liquid ring pump requires numerous bearings. The interior of the pump requires two slide bearings for supporting the pump shaft on which an inner magnet carrier of the magnetic coupling is mounted. Further, two roller bearings are provided to hold an outer magnet carrier of the magnetic coupling, and two regular bearings are provided for the separate electric motor. Thus, a total of six bearings is required, resulting in a complex configuration that leads further to a relatively great structural length of the overall apparatus comprised of pump, canned magnetic coupling and electric motor. When damage occurs, in particular of the enclosure, the magnetic coupling and the supporting bearing react relatively sensitively. Thus, it is not easy to provide measures which prevent or at least substantially reduce the risk of escape of transport fluid or operating fluid of the pump, when the enclosure is damaged. In particular, when toxic and/or aggressive or expensive transport fluids are involved, an escape of such fluids is detrimental.

It would therefore be desirable and advantageous to provide an improved liquid ring pump which obviates prior art shortcomings and which is compact and simple in structure while yet reliable in operation for basically any type of operating fluid.

SUMMARY OF THE INVENTION

According to one aspect of the present invention, a liquid ring pump includes a stationary housing defining an interior space; at least one rotor mounted in the interior space on a rotor shaft for rotation in the housing; a bearing for supporting the rotor shaft in the interior space; and a drive, acting on the outer perimeter of the rotor, for driving the rotor.

The housing of the liquid ring pump may either be configured with a single interior space or split horizontally to divide the interior in several spaces, typically two spaces. This simplifies the fabrication of the housing. The rotor is suitably provided with a partition wall to separate the interior spaces.

According to another feature of the present invention, the bearings of the rotor shaft may be configured as slide bearings which are lubricated and cooled by the operating fluid. The rotor and the rotor shaft can suitably be made of a same material, for example in the form of a single-piece casting. This single-piece configuration is equally applicable for all known construction principles such as conical configuration of liquid ring pumps. There are no problems relating to gap seals between individual stages of a multi-stage liquid ring pump as the partition wall is immersed over the entire circumference in the liquid ring.

According to another feature of the present invention, the outer perimeter of the rotor may be configured as a gear wheel which projects into a bay of the housing and cooperates with a force-transmitting member of the drive in the form of a pinion which is accommodated in the bay and transmits the torque from the electric motor to the gear. The pinion is hereby lubricated by the operating fluid and has a pinion shaft which is suitably supported by slide bearings. The bay requires only one bore for passage of the pinion shaft, whereby the bore can easily be sealed by a gland or mechanical seal. Suitably, the electric motor of the drive is placed externally and has a driveshaft which is axially offset to the rotor shaft.

A liquid ring pump according to the present invention exhibits a superior efficiency compared to prior art pumps and requires a smaller torque of the drive. The useful portion of the working chamber can now be made of greater size than in conventional liquid ring pumps while maintaining same outer dimensions. Further, the rotor shaft may have a smaller diameter compared to conventional liquid ring pumps as the required drive torque is not transmitted via the rotor shaft. As a consequence of the conjointly rotating partition wall of the rotor, less frictional losses are encountered. Compared to conventional liquid ring pumps, a liquid ring pump according to the present invention requires less space and a reduced number of components. There is no need for a separate lubrication so that the liquid ring pump according to the present invention runs completely free from grease. Thus, also two-stage or multi-stage configurations as vacuum pumps and compressors are possible as differently split axial rotor halves may have varying diameters. Except for the feedthrough of the pinion shaft to the drive, the liquid ring pump according to the invention is completely hermetically sealed and only a single area (feedthrough in the bay) needs to be sealed.

According to another feature of the present invention, the rotor is driven by a device which influences the rotation speed of the liquid ring pump, with the electric motor driving the rotor via a converter or a gear mechanism. The liquid ring pump can then be utilized for a wide range of industrial processes which demand different rotation speeds, i.e. different compression conditions.

According to another feature of the present invention, an infinitely variable control of the rotation speed of a liquid ring pump according to the invention can be implemented by configuring the outer perimeter of the partition wall of the rotor in the form of a water turbine and thus to drive the rotor by a jet of a fluid such as gas or liquid, e.g. water. In this way, the rotation speed can be controlled by the applied fluid pressure or fluid amount. Configuration of such a hydrodynamic drive eliminates the need for a drive motor, thereby further reducing the dimensions of the overall liquid ring pump. Fluid pressure and fluid amount can be generated by a centrifugal pump, whereby the fluid is conducted in a closed loop or supplied from a cooling water mains if water is used as fluid. The amount of cooling water is hereby sufficient to avoid a recooling. The reservoir, typically designed as separator may, however, contain a cooling coil for recooling of the operating water. Thus, the driving water for the rotor can be used at the same time as operating water of the liquid ring pump.

BRIEF DESCRIPTION OF THE DRAWING

Other features and advantages of the present invention will be more readily apparent upon reading the following description of preferred exemplified embodiments of the invention with reference to the accompanying drawing, in which.

DETAILED DESCRIPTION OF PREFERRED EMBODIMENTS

Figure 1:
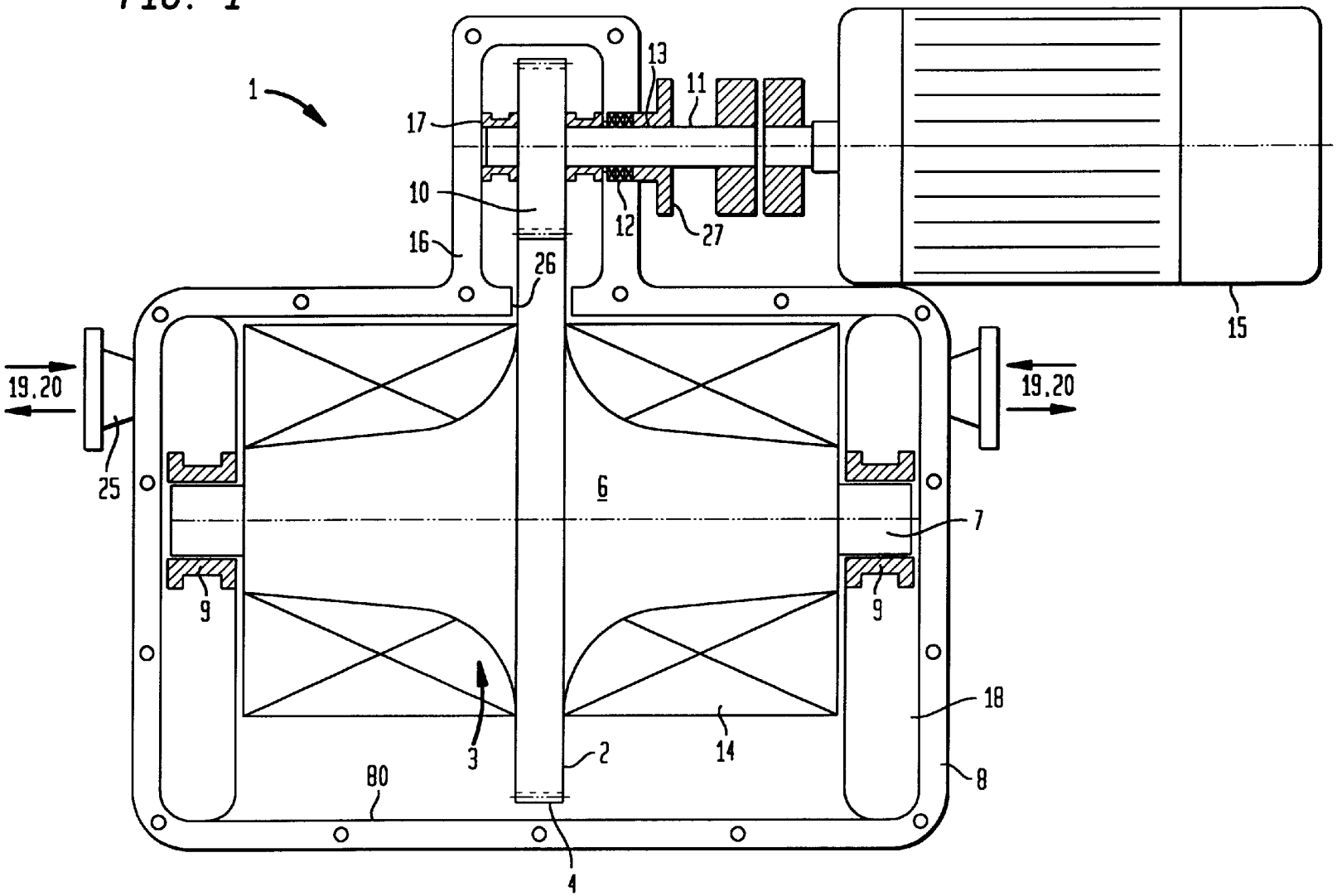
FIG. 1 is a longitudinal section of a first embodiment of a liquid ring pump according to the present invention.

Throughout all the Figures, same or corresponding elements are generally indicated by same reference numerals.

Turning now to the drawing, and in particular to FIG. 1, there is shown a longitudinal section of a first embodiment of a double-flow liquid ring pump according to the present invention, generally designated by reference numeral 1. For sake of simplicity, the following description will refer to liquid ring pumps only, but it will be understood by persons skilled in the art, that the principles described in the following description are generally applicable to compressors or other types of pumps as well.

The liquid ring pump 1 includes a stationary housing 8 which is filled with an operating liquid, including toxic and/or aggressive liquids, and accommodates a rotor, generally designated by reference numeral 3 and formed with a central partition wall 2 to split the interior of the housing 8 horizontally in two interior spaces, preferably two identical interior spaces. The rotor 3 is mounted eccentrically in the housing 8 on a rotor shaft 7 and includes in each of the interior spaces a hub 6 and a plurality of vanes 14 which extend radially from the hub 6 and terminate at a distance to the inside wall surface 80 of the housing 8 and define working chambers or cells between neighboring vanes 14. The rotor shaft 7 is supported at its axial ends by two slide bearings 9 and is suitably made of a same material as the rotor 3. For example, the rotor 3 and the rotor shaft 7 may form a single-piece casting. The slide bearings 9 are lubricated and cooled by the operating fluid contained in the interior of the housing 8.

Upon rotation of the rotor 3, the liquid forms a liquid ring at the inner wall surface 80 to seal the working chambers to the outside. As a consequence of the eccentricity of the rotor 3, the working chambers change their volume, thereby producing a pumping action, with liquid being aspirated and discharged through separate inlet and outlet passages, indicated by arrows 19, 20, in conical port member 25. Operation of liquid ring pumps is generally known to the artisan and thus not described in more detail for sake of simplicity.

The partition wall 2 of the rotor 3 has a geared outer perimeter 4 and, as a consequence of the eccentric disposition of the rotor 3, projects through an opening 26 in the housing 8 into a bay 16 which is formed in one piece with the housing 8. Fitted in the bay 16 is a force-transmitting member in the form of a pinion 10 which is in mesh with the partition wall 2 and may be made of plastics or any other suitable material. The pinion 10 is mounted in fixed rotative engagement on a driveshaft 11 which extends through a bore 13 and is operatively connected to an electric motor 15. Cooling and lubrication of the pinion 10 is effected by the operating fluid as a result of the fluid communication between the housing interior and the bay 16. Only one seal 12 is thus required and placed in the bore 13 of the bay 16. A plug 27 is provided to secure the seal 12 in place. The pinion 10 is secured in place by spacers 17 so as to ensure a proper mesh with the gear on the outer perimeter 4 of the partition wall 2.

Disposed interiorly at opposite axial end faces of the housing 8 are control disks 18 in parallel relationship to the partition wall 2 of the rotor 3 for controlling ingress and egress of operating fluid through the port members 25.

Persons skilled in the art will appreciate that the reference to a pinion in conjunction with the drive for the rotor represents merely a presently preferred embodiment for the particular usage that the inventor contemplated, and other configurations which generally follow the concepts outlined here are considered to be covered by this disclosure. As an example, the drive may also include a toothed belt for interaction with the geared partition wall. Although not shown in detail in the drawing, it will further be appreciated by persons skilled in the art that the bay 16 may be formed with more than one bore 13 to allow selective disposition of the driveshaft 11, whereby the unused bores are tightly sealed by suitable elements such as a plug.

Figure 2:
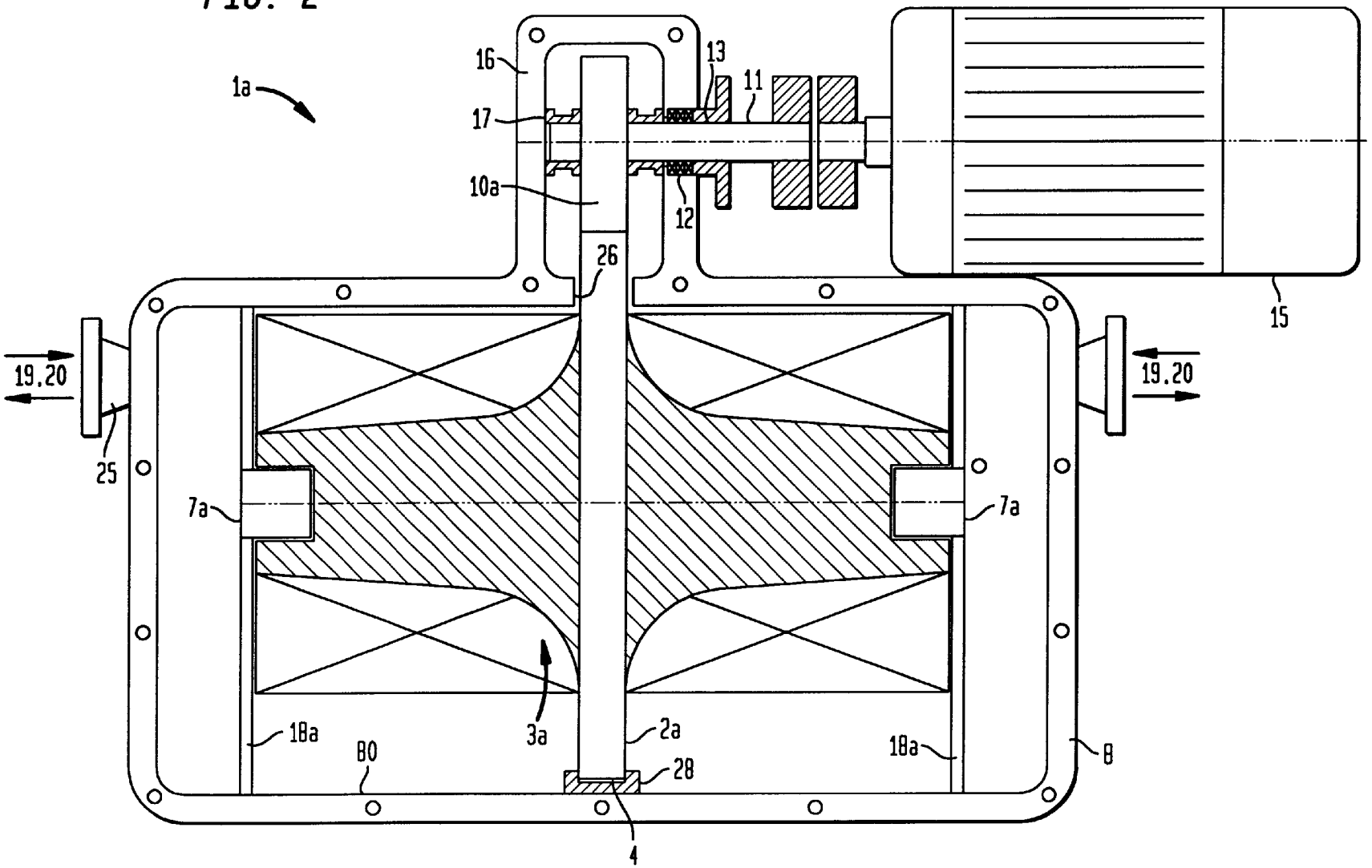
FIG. 2 is a longitudinal section of a second embodiment of a liquid ring pump according to the present invention.

Turning now to FIG. 2, there is shown a longitudinal section of a second embodiment of a liquid ring pump according to the present invention, generally designated by reference numeral 1*a*. In describing the FIG. 2, like parts of the liquid ring pump 1*a* corresponding with those of the liquid ring pump 1 in FIG. 1 will be identified by corresponding reference numerals, followed by the distinguishing character "a" in case corresponding but modified elements are involved. In this embodiment, provision is made for a force-transmitting member in the form of a friction roller 10*a* for transmitting the torque of the electric motor 15 to the outer perimeter 4 of the partition wall 2*a* of the rotor 3*a* through frictional engagement therewith. The rotor 3*a* is hereby mounted on fixed rotor shafts 7*a* which are part of the control disks 18*a* at the end faces of the housing 8. A guide track 28, mounted interiorly on the inside wall surface 80 of the housing 8, keeps the rotating partition wall 2 in proper alignment.

Persons skilled in the art will appreciate that the reference to a friction roller as force-transmitting member in conjunction with the drive for the rotor represents merely a presently preferred embodiment for the particular usage that the inventor contemplated and other configurations which generally follow the concepts outlined here are considered to be covered by this disclosure. As an example, the drive may also include a pulley for interaction with the partition wall.

Figure 3:
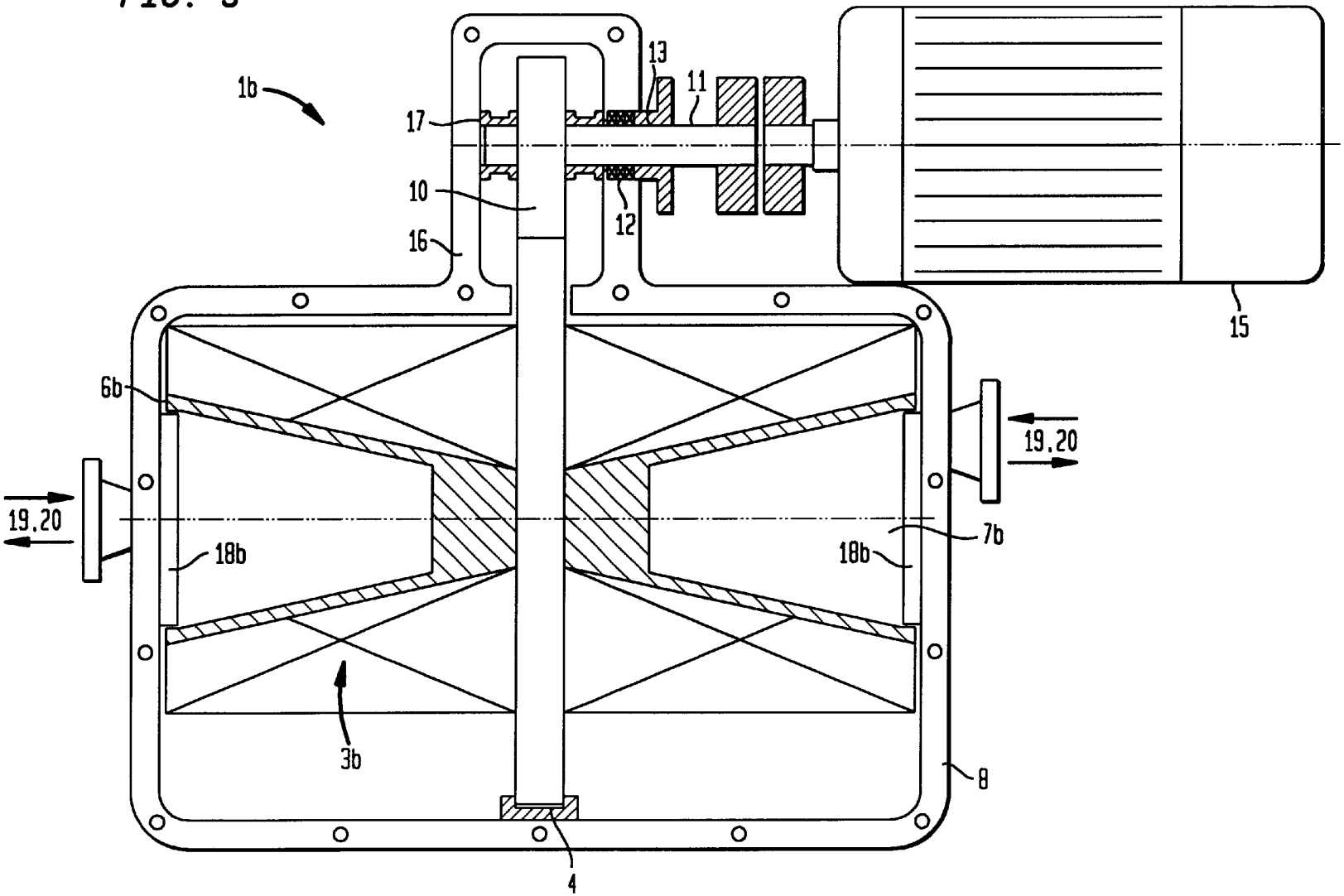
FIG. 3 is a longitudinal section of a third embodiment of a liquid ring pump according to the present invention.

FIG. 3 shows a longitudinal section of a third embodiment of a liquid ring pump according to the present invention, generally designated by reference numeral 1*b*. In describing the FIG. 3, like parts of the liquid ring pump 1*b* corresponding with those of the liquid ring pump 1*a* in FIG. 2 will be identified by corresponding reference numerals, followed by the distinguishing character "b" in case corresponding but modified elements are involved. In this embodiment, provision is made for a rotor 3*b* having hubs 6*b* of conical configuration with conical rotor shafts 7*b* projecting inwardly from the control disks 18*b*, whereby the inlet and outlet passages 19, 20 are positioned in substantial axial alignment with a center axis of the rotor 3*b*.

Figure 4:
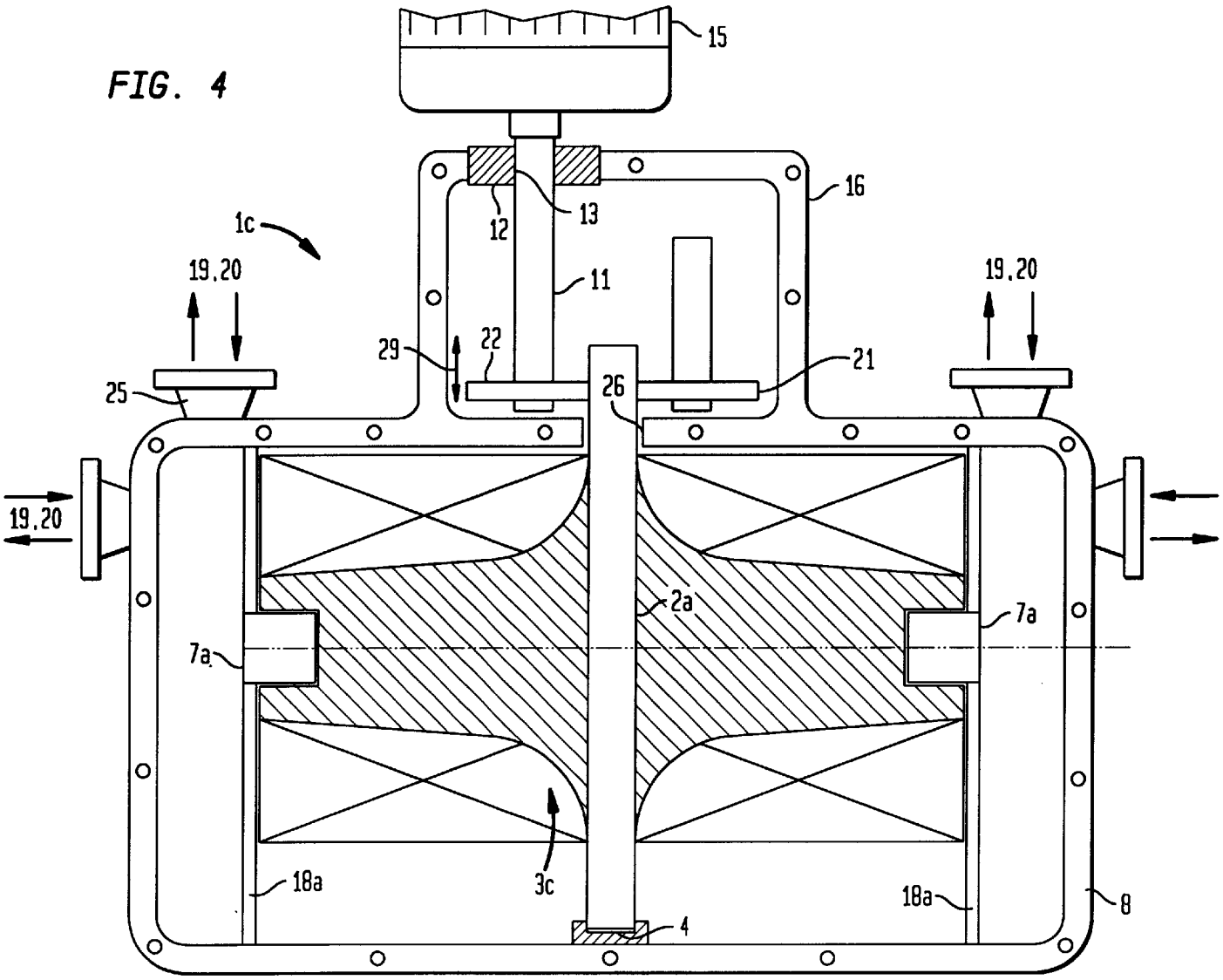
FIG. 4 is a longitudinal section of a fourth embodiment of a liquid ring pump according to the present invention.

Turning now to FIG. 4, there is shown a longitudinal section of a fourth embodiment of a liquid ring pump according to the present invention, generally designated by reference numeral 1*c*. In describing the FIG. 4, like parts of the liquid ring pump 1*c* corresponding with those of the liquid ring pump 1*a* in FIG. 2 will generally be identified by corresponding reference numerals. In this embodiment, the driveshaft 11 of the electric motor 15 extends perpendicular to the rotor shaft 7*a*. The rotor 3*c* has a partition wall 2*c* which projects through the opening 26 into the bay 16 and interacts with a friction drive including a drive roller 22 which is mounted on the driveshaft 11 for movement in axial direction, as indicated by double arrow 29. A support roller 21 is provided as abutment and suitably secured in the bay 16. Thus, the torque of the electric motor 15 is transmitted via the drive roller 22 to the outer periphery of the partition wall 2*c* of the rotor 3*c*. Through change of the axial position of the drive roller 22 on the driveshaft 11, the angular velocity and thus the rotation speed of the rotor 3*c* can be varied. The port members 25 for the inlet and outlet ports 19, 20 of the liquid ring pump 1*c* are positioned on the end faces of the housing 8, or as shown here on top of the housing 8 on either side of the bay 16.

Figure 5:
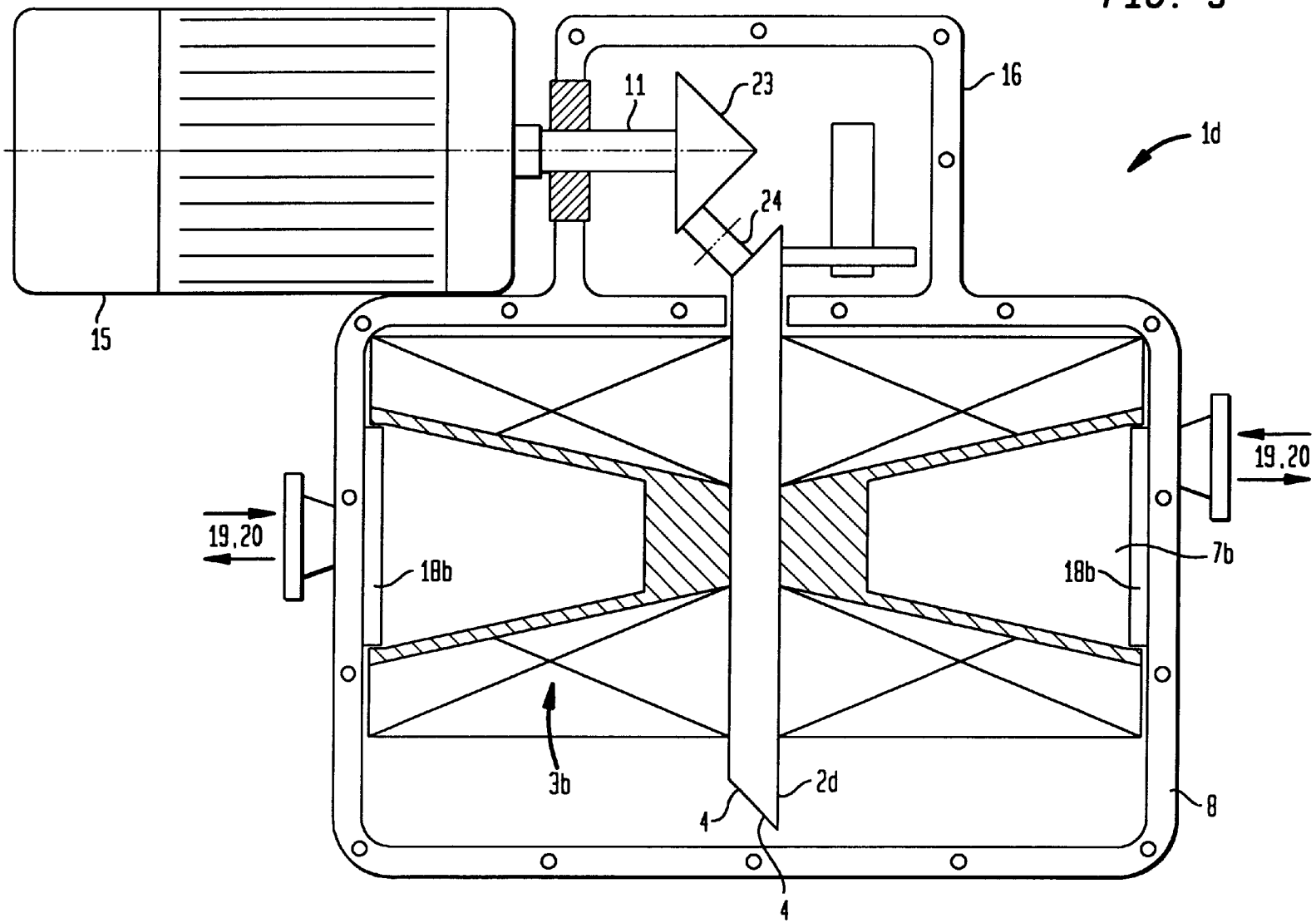
FIG. 5 is a longitudinal section of a fifth embodiment of a liquid ring pump according to the present invention.

FIG. 5 shows a longitudinal section of a fifth embodiment of a liquid ring pump according to the present invention, generally designated by reference numeral 1*d* and based on the embodiment of the liquid ring pump 1*b* in FIG. 3 but showing a variation for changing the rotation speed of the rotor 3*b*. In describing the FIG. 5, like parts of the liquid ring pump 1*d* corresponding with those of the liquid ring pump 1*b* in FIG. 3 will be identified by corresponding reference numerals, followed by the distinguishing character "d" in case corresponding but modified elements are involved. The driveshaft 11 of the electric motor 15 extends in parallel relationship to the rotor shaft 7*b* and is connected at its motor-distal end with a bevel gear 23 in mesh with a displaceable intermediate roller 24 which in turn interacts with a conical end face of the partition wall 2*d* of the rotor 3*b*. A displacement of the intermediate roller 24 with respect to the bevel gear 23 and the partition wall 2*d* results in a change of the rotation speed.

Figure 6:
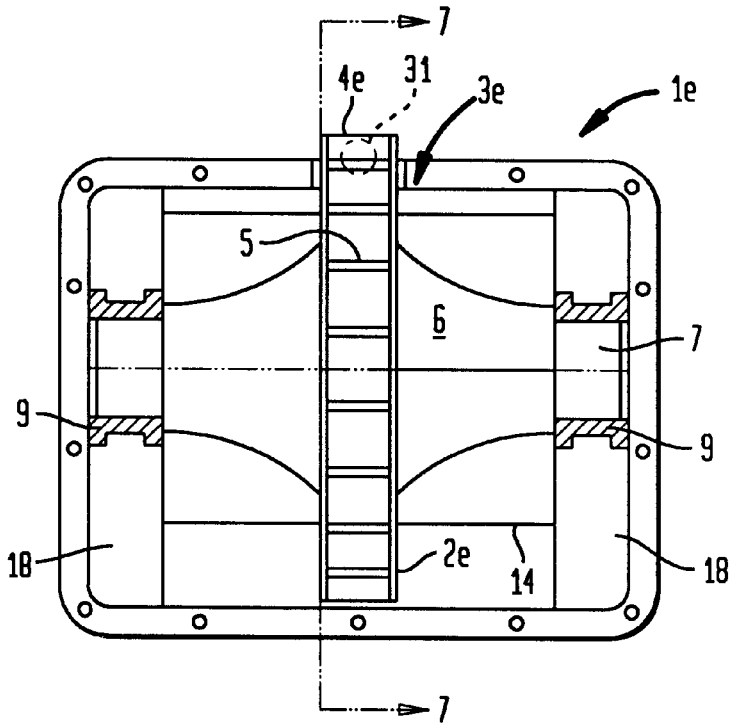
FIG. 6 is a longitudinal section of a sixth embodiment of a liquid ring pump according to the present invention.
Figure 7:
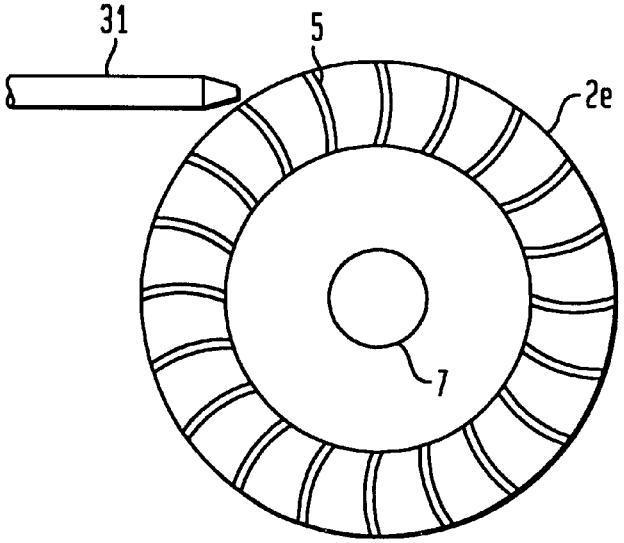
FIG. 7 is a schematic illustration of the liquid ring pump, taken along the line VII—VII in FIG. 6.

Turning now to FIG. 6, there is shown a longitudinal section of a sixth embodiment of a liquid ring pump according to the present invention, generally designated by reference numeral 1*e* and based on the embodiment of the liquid ring pump 1 in FIG. 1. In describing the FIG. 6, like parts of the liquid ring pump 1*d* corresponding with those of the liquid ring pump 1*b* in FIG. 3 will be identified by corresponding reference numerals, followed by the distinguishing character "e" in case corresponding but modified elements are involved. In this embodiment, the partition wall 2*e* has an outer perimeter 4*e* configured in the shape of a water turbine with vanes 5, preferably of the pelton type or Francis type. One or more nozzles 31 are spaced about the circumference of the partition wall 2*e* of the rotor 3*e* in substantial tangential disposition thereto in order to direct a gas or liquid, e.g. water, jet onto the perimeter of the partition wall 2*e* and thereby drive the rotor 3*e*, as shown in FIG. 7. By adjusting the volume flow and pressure of the fluid jet and the number of nozzles 31, the rotation speed of the rotor 3*e* and the torque being transmitted can be adjusted. This embodiment differs from the previous embodiments of a liquid ring pump by the omission of a direct motor drive.

Common to all embodiments described herein is the action of the drive upon the outer perimeter of the rotor for transmission of the required torque. Through different diameters of the rotors in both interior spaces of the housing 8, two-stage compressors can be realized. A flat configuration of the housing top allows a direct attachment on clutchable motors.

While the invention has been illustrated and described as embodied in a liquid ring pump, it is not intended to be limited to the details shown since various modifications and structural changes may be made without departing in any way from the spirit of the present invention.

What is claimed as new and desired to be protected by Letters Patent is set forth in the appended claims:

1. liquid ring pump, comprising:

a stationary housing defining an interior space;

a rotor mounted in the interior space on a rotor shaft for rotation in the housing, said rotor having an outer perimeter;

a bearing assembly for supporting the rotor shaft in the interior space; and a drive, acting on the outer perimeter of the rotor, for driving the rotor.

2. The pump of claim 1, wherein the drive includes an electric motor having a driveshaft which is axially offset to the rotor shaft.

3. The pump of claim 2, wherein the drive has adjusting means, operatively connected to the electric motor, for controlling a rotation speed of the rotor.

4. The pump of claim 1, wherein the rotor defines a partition wall, with the outer perimeter configured in the form of a water turbine, wherein the drive includes a fluid-operated system with at least one nozzle for directing a fluid jet tangentially upon the outer perimeter.

5. The pump of claim 1, wherein the housing has a bay defining an interior space in fluid communication with the interior space of the housing, wherein the drive includes a force-transmitting member accommodated in the bay and interacting with the outer perimeter of the rotor.

6. The pump of claim 1, wherein the bearing assembly includes a slide bearing.

7. The pump of claim 1, wherein the rotor and the rotor shaft form a single-piece configuration.

8. The pump of claim 1, wherein the rotor and the rotor shaft form a single-piece casting.

9. The pump of claim 5, wherein the outer perimeter of the rotor is formed as a gear which is operatively connected to the drive and projects into the bay, said drive including said force-transmitting member in the form of a pinion and in mesh with the gear.

10. The pump of claim 5, wherein the force-transmitting member is a friction roller in frictional engagement with the outer perimeter of the rotor.

11. The pump of claim 10, wherein the drive includes an electric motor having a driveshaft extending perpendicular to the rotor shaft, said friction roller being movably mounted on the driveshaft to allow control of a rotation speed of the rotor.

12. The pump of claim 5, wherein the force-transmitting member includes a bevel gear and an intermediate roller meshing with the bevel gear and acting on the outer perimeter of the rotor.

13. The pump of claim 12, wherein the drive includes an electric motor having a driveshaft extending parallel to the rotor shaft, said intermediate roller being mounted for displacement to thereby allow control of a rotation speed of the rotor.

14. A liquid ring pump for use with toxic and/or aggressive fluids, comprising:

a stationary housing defining an interior space;

a rotor mounted in the interior space on a rotor shaft for rotation in the housing, said rotor having an outer perimeter;

a bearing for supporting the rotor shaft in the interior space; and a drive, acting on the outer perimeter of the rotor, for driving the rotor.

15. A liquid ring pump for a pump output of greater than 50 KW, comprising:

a stationary housing defining an interior space;

a rotor mounted in the interior space on a rotor shaft for rotation in the housing, said rotor having an outer perimeter;

a bearing for supporting the rotor shaft in the interior space; and a drive, acting on the outer perimeter of the rotor, for driving the rotor.

16. A liquid ring pump, comprising:

a housing defining an interior space;

a rotor assembly mounted in the interior space on a rotor shaft for rotation in the housing, said rotor having a partition wall dividing the interior space and having an outer perimeter;

a bearing assembly for supporting the rotor shaft in the interior space; and a drive, acting on the outer perimeter of the partition wall, for driving the rotor.

* * * * *